United States Patent [19]

Laramie

[11] Patent Number: 4,787,663

[45] Date of Patent: Nov. 29, 1988

[54] CHOPSTICK HOLDER

[76] Inventor: Leon A. Laramie, P.O. Box 3493, Redwood City, Calif. 94064

[21] Appl. No.: 56,809

[22] Filed: Jun. 2, 1987

[51] Int. Cl.[4] ..... A47G 21/10; A47J 43/28

[52] U.S. Cl. ..... 294/99.2

[58] Field of Search ..... 294/99.2, 33, 16, 3, 294/8.5, 11, 25, 99.1, 103.1, 104, 106; D7/105; 30/135, 142, 150

[56] References Cited

U.S. PATENT DOCUMENTS

| | | | |
|---|---|---|---|
| D. 233,398 | 10/1974 | Lee | 294/99.2 |
| 3,186,749 | 6/1965 | Dawes | 294/99.2 |
| 4,659,128 | 4/1987 | Dong | 294/99.2 |

*Primary Examiner*—James B. Marbert

*Attorney, Agent, or Firm*—David Pressman

[57] ABSTRACT

A chopstick holder (10) comprises a rectangular body with a pair of through holes (20, 22) having diameters larger than tip portions of the sticks, but smaller than the top ends of the sticks, so that when the chopsticks are inserted in the holder, they are firmly held in it by friction. The holding portions are linked by a connection portion (32), which is preferably resilient. Another embodiment of the holder includes tapered splines (36, 38) on the inner surfaces of the holes to gouge longitudinal grooves on the chopsticks to prevent the sticks from rotating in the holes. The holes may have round or square cross sections. The holder may be shifted down the sticks to increase operating force.

16 Claims, 2 Drawing Sheets

CHOPSTICK HOLDER

BACKGROUND--FIELD OF THE INVENTION

The present invention relates to kitchen utensils, particularly to a chopstick holder intended for convenient holding of chopsticks.

BACKGROUND--DESCRIPTION OF THE PROBLEM

Nowadays, Chinese and Japanese food is very popular, not only in China and Japan, but also in Europe and in the United States. It would not be exaggeration to say that, for example, in certain areas of San Francisco and Los Angeles, Chinese and Japanese restaurants exceed the number of American and European restaurants. In traditional Asian restaurants, the only utensils used for picking up food are chopsticks two small sticks of wood or ivory, held together in one hand and used to lift food to the mouth. Normally one chopstick is held between the end of the thumb and the index finger, and the other is held between the base of the thumb and the side of the middle finger. The second chopstick is held in a fixed position while the first is moved toward and away from the second to pick up pieces of food betwen distal ends of the two sticks. Chopsticks made of wood or ivory are more hygienic than metal.

It is obvious that the use of such utensils requires certain experience, and people who have no such experience will feel quite uncomforatable and awkward while eating with chopsticks instead of a traditional fork. Young children, elderly persons, and persons with imparied coordination, irrespective of their origins (Asian or European), may also experience difficulties in using chopsticks. While a fork can be substituted for the chopsticks in Oriental restaurants, this will deprive the user of some of the pleasure and satisfaction of Oriental eating.

In addition, even if one has leanred to use chopsticks, the two separate sticks do not provide any resistance or "springback", much less any adjustable resistance, thereby making them difficult to open after closure. Also, unless the sticks are square or rectangular in cross section, they sometimes tend to rotate about their longitudinal axes, compounding the difficulty of use.

Chopsticks are also useful for other purposes. E.g., nonmetallic chopstics are useful for removing bread which is hot or which is jammed in a toaster without risk of shock. However due to aforementioned difficulty of use, chopsticks have seldom been employed for this advantageous use.

OBJECTS AND ADVANTAGES OF THE PRESENT INVENTION

Therefore an object of the present invention is to provide a way to facilitates use of chopsticks by an unskilled user. Other objects are to provide chopsticks with a springy or elastic resistance to squeezing force, causing them to open automatically, to provide such resistance which is variable in force, to provide means for preventing the sticks from rotating on their longitudinal axes, and to provide a way to use chopsticks easily for removing bread which is stuck in a toaster. Further objects, features, and advantages of the invention will be understood after consideration of the ensuing description and the attached drawings.

DRAWINGS

Figure 1:
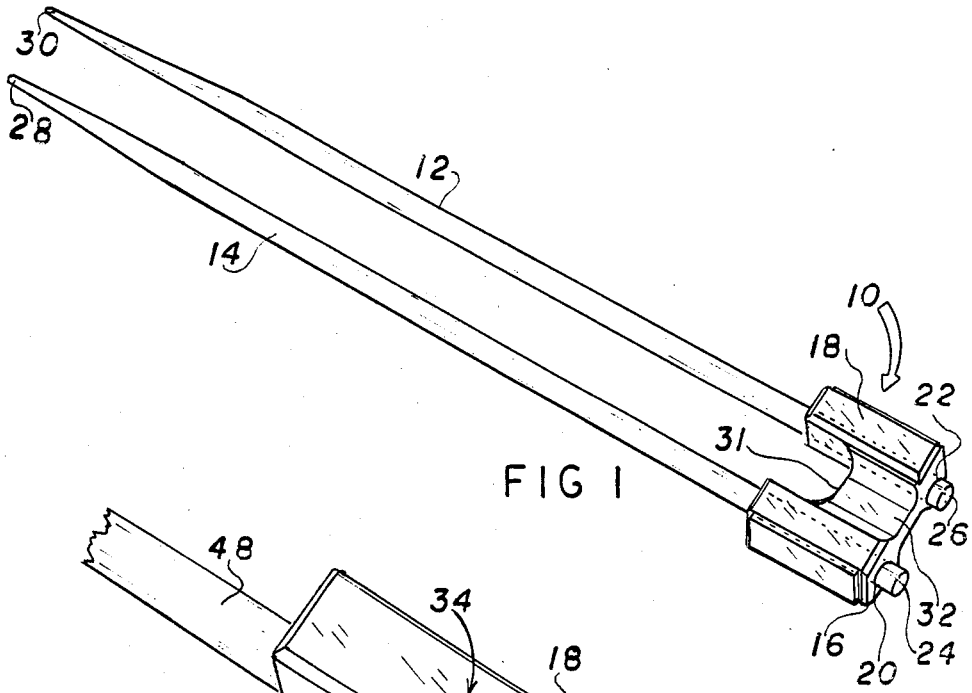
FIG. 1 is a perspective view of a chopstick holder of the invention in use with plain round chopsticks.

Reference Numerals Used in the Specification and Drawings

10, 34, 52—chopstick holders
12, 14, 48, 50, 58, 60—round and square chopsticks
16, 18—holding portions
20, 22, 40, 42, 54, 56—through holes
24, 26—top ends of the chopsticks
28, 30—tips of the chopsticks
31—curved profile
32—connection portion
36, 38—splines
44—longitudinal grooves
70—user's pointing finger
72—user's thumb
74—food
76—user's middle finger

FIG. 1—Description of Plain Chopstick Holder

In accordance with the invention, a chopstick holder is provided which can hold a pair of chopsticks a fixed distance apart, in parallel, while still enabling the chopsticks to be easily held and squeezed together so that their tips can be used to pick up pieces of food, or any other small items.

A general perspective view of a chopstick holder 10 of the invention in combination with conventional chopsticks 12 and 14 of a round cross section is shown in FIG. 1. Holder 10 comprises a substantially rectangular-shaped body which has two elongated holding portions 16 and 18. Holding portions 16 and 18 contain respective through holes 20 and 22 which are parallel to each other and which pass through the holding portions in a longitudinal direction. Holes 20 and 22 are intended to receive respective chopsticks 12 and 14. Each of holes 20 and 22 has a slightly smaller diameter than top ends 24 and 26 of chopsticks 12, but a larger diameter than tips 28 and 30 of the sticks. When, therefore, the chopsticks are inserted into holder 10 by guiding tips 28 and 30 through holes 20 and 22, the chopsticks are held in the through holes by friction between top portions 24 and 26 and the walls of through holes 20 and 22.

Holding portions 16 and 18 are linked by a connection portion 32 which has a thinned cross section and a shorter length in longitudinal direction than the overall vertical length of holder 10. Connection portion 32 imparts to holder 10 enough flexibility to allow tips 28 and 30 to be moved toward each other to hold items of food therebetween. The lower side of connection portion 32 has a convex profile 31, but may be straight and parallel to the upper surface of holder 10. Connection portion 32 may have a thickness within the range of 6 mm to 10 mm (¼" to ⅜"), or about 50% of the width of holder 10 in its cross section.

Figure 2:
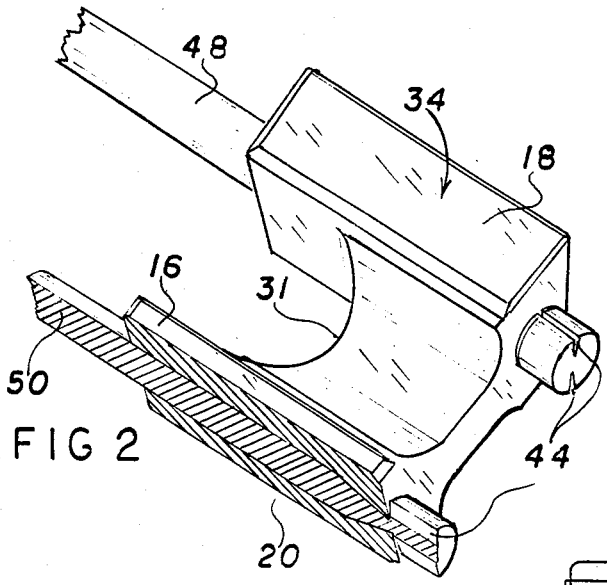
FIG. 2 is a partially-broken away, perspective view of a chopstick holder with splines for use with grooved round chopsticks.
Figure 3:
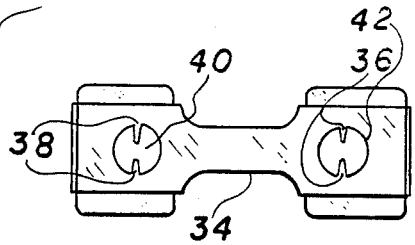
FIG. 3 is a top view of the chopstick holder of FIG. 2.
Figure 4:
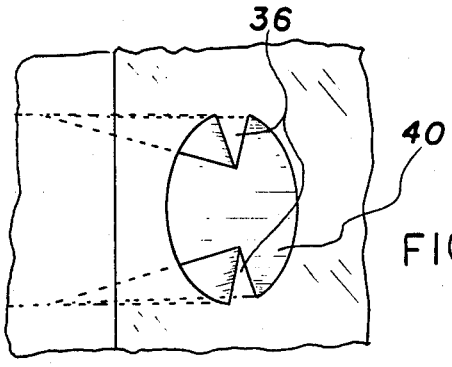
FIG. 4 is a perspective partial view of the rear part of the holder of FIG. 2.

FIGS. 2 to 4—Description of Splines Chopstick Holder

FIGS. 2, 3, and 4 show another embodiment of the invention where a holder 34 has two tapering groove-cutting splines, or keys 36 in through opening 42, and 38 in through opening 40.

As shown in FIG. 4, tapering splines 36 and 38 have a limited length (about 6 mm to 10 mm or about 5 to 7% of the length of the holder). Each spline is about 2–3 mm high at the rear end of the holder and tapers down to the side of its through hole (40 or 42) at an angle of 3° to 5° to the axis of its hole. Chopsticks 48 and 50 have mating longitudinal keyways or grooves 44 which improve the grip of the holder on the chopsticks and prevent the sticks from rotating on their longitudinal axes. These grooves preferably are formed by inserting ungrooved sticks 48 and 50 of soft wood into the holder, wide ends first, so that splines 36 of the holder will gouge grooves 44 in the sticks. Alternatively the grooves can be pre-formed in the sticks.

Figures 5, 6, 7:
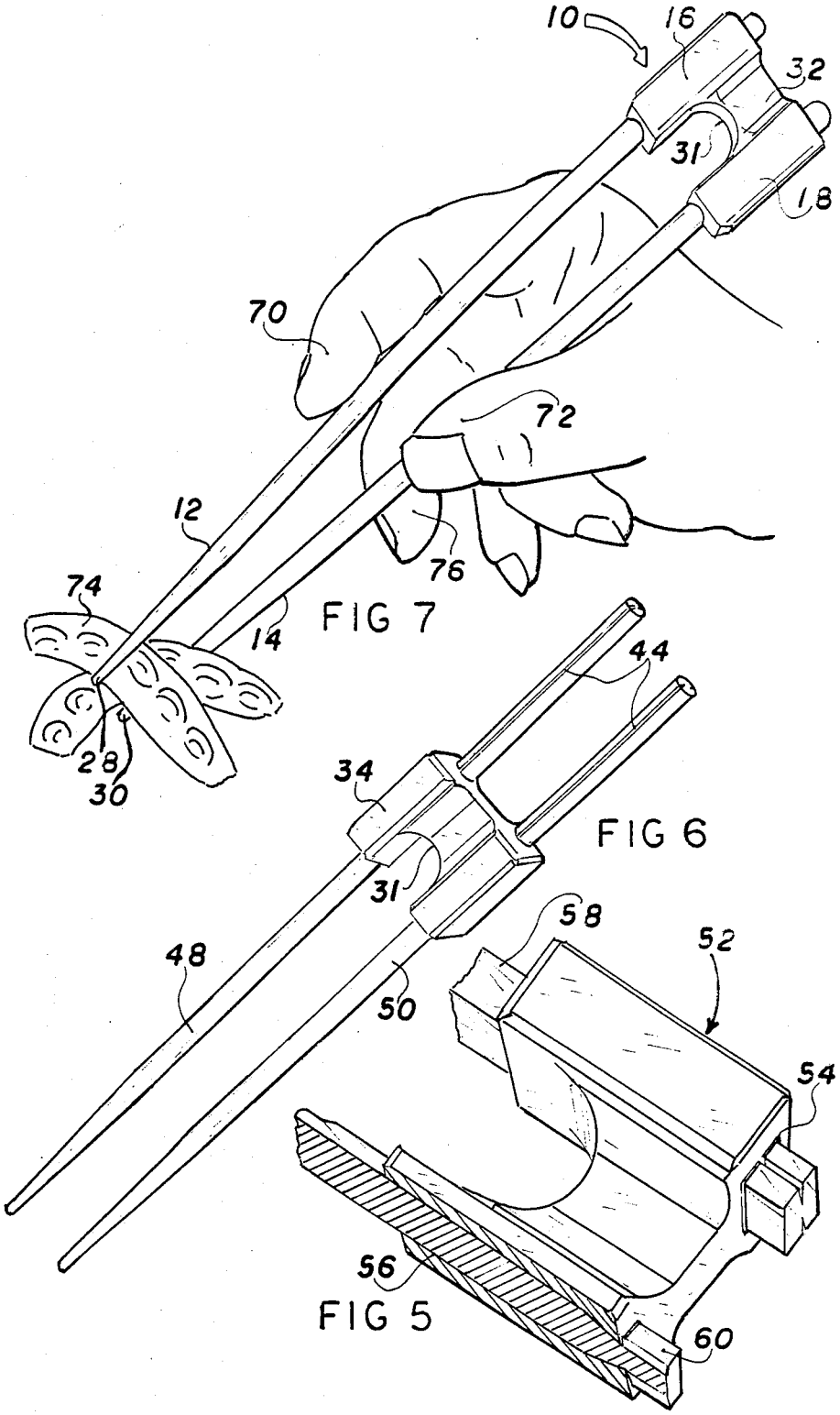
FIG. 5 is a view of a holder similar to one shown in FIG. 2, but instead for holding chopsticks which have a square cross section.
FIG. 6 is a perspective view of the holder of FIG. 2 for round and grooved chopsticks with the holder positioned part way down to increase the resistance to squeezing force.
FIG. 7 is a perspective view illustrating the holder and chopsticks in use.

FIG. 5—Square Chopstick Holder

FIG. 5 illustrates another embodiment of a chopstick holder 52 according to the invention. Chopstick holder 52 is generally the same as holder 34 of FIGS. 2 to 4, except that it has through holes 54 and 56 of square cross sections for holding square chopsticks 58 and 60. As with the embodiment of FIG. 2, the holder also has groove-cutting splines and has cut mating grooves into its chopsticks.

FIG. 6—Choking Up

FIG. 6 illustrates round and grooved chopsticks 48 and 50 in splined holder 34. Here holder 34 has been moved part way down or "choked up" on the chopsticks to increase resistance to squeezing force when the sticks are held. The splines on the holder (not shown in FIG. 6 but shown at 36 in FIGS. 3 and 4) will gouge elongated grooves 44 in sticks 56 and 58 as far as the holder is moved down the sticks.

Sticks 48 and 50 should have a cylindrical shape with a fixed diameter on the upper portions to provide a uniform retention force, irrespective of the position of the holder on the stick grooves.

Dimensions and Materials

In the embodiments described and shown, the holder may have a length of about 3 cm (1¼"), a width of about 4, 5 cm (1¾"), and a thickness of 1¼" cm (½").

Holders 10, 34, and 52 can be made of any slightly resilient material, such as nylon, polycarbonate, acrylic plastic, etc. However, even if the holder is made of a non-resilient material, such as wood or metal, the chopsticks themselves will have sufficient flexibility to be used, as described infra. The holder can be molded or machined. The sticks can be made of wood or ivory. It should be understood that the shapes and configurations of the holders shown above are given only for illustrative purposes and that many variations of the design of the holder are possible.

FIG. 7—Operation of the Chopstick Holder

The use of the chopstick holder of the invention will now be described with reference to FIG. 7, which shows an assembly of grooveless round sticks 10 and 12 with a splineless holder 10. It is obvious that the holders of other modifications have the same principle of operation and therefore do not need a separate consideration.

For use, the user inserts tips 28 and 30 of sticks 12 and 14 into through holes 20 and 22 in the top side of holder 10. The sticks are then pushed until they are firmly fixed in holes 20 and 22 by friction between the walls of these holes and the sticks and until a small part of the large end of each stick protrudes from the holder's top, as shown. The user then holds sticks 12 and 14 between thumb 72 and pointing finger 70, sandwiches one or more pieces of food 74 between tips 28 and 30, and squeezes the sticks so as to cause tips 28 and 30 to grasp the food. For convenience, the user's middle finger 76 can be used as an additional support, but no more as a fulcrum point, the function of which is now fulfilled by connection portion 32 of the holder. Resiliency and resistance to squeezing also is provided by thinned connection portion 32. No skill or training is needed to use chopsticks when the holder is employed.

In the embodiments of FIGS. 2 to 5, the operation of the holder will be the same. Here the splines will gouge the grooves when the sticks are inserted; the mating grooves and splines will prevent the sticks from rotating on their longitudinal axes.

As shown in FIG. 6, holder 34 can be moved down the sticks, along grooves 44, to increase the resistance to squeezing. The resistance to squeezing increases in proportion to the distance the holder is moved down the stick.

Conclusion, Ramifications, and Scope

I have just described and shown a chopstick holder which enables chopsticks to be used by an unskilled user. Also the holder of the invention prevents the sticks from rotating around their longitudinal axes and makes it possible to adjust the resistance to squeezing.

Although the invention was described and illustrated with reference to specific embodiments, it is understood that these embodiments should not be construed as limiting and that any other modifications are possible without departure from the scope of the appended claims. For example, in the drawings, holders 10, 34, and 52 have dumbbell-like cross-sectional configurations. They, however, may have the shape of a mere block with a softer central portion than the stick holding portions. The holders may have spherical or oval shapes as well. They can be made with more than two splines. The sticks and through holes may have different cross sections, apart from round and square shown in the drawings. For example, they may have a triangular cross section. In this case, the holes can be replaced by dovetail grooves on the side surfaces of the holder. Materials other than those mentioned above can be used for the manufacture of holders. The inner surface of the connection portion of the holder may have a triangular shape rather than a straight-lined or curved profile. Therefore, the scope of the invention should be determined not by the examples given, but rather by the appended claims and their legal equivalents.

I claim:

1. A chopstick holder, comprising:

a pair of elongated holding portions having a pair of respective through holes of a predetermined dimension for holding a pair of chopsticks of a predetermined transverse dimension in a generally parallel relationship and with the dimensions of said through holes being such that said chopsticks will be held by frictional engagement when they are inserted into said respective through holes, and connecting means for holding said holding portions a fixed distance apart, and in a generally parallel relationship, said fixed distance being at least twice the dimension of each of said through holes, said holding portions having a predetermined thickness, greater than said chopsticks, when measured in a predetermined direction perpendicular to their direction of elongation and perpendicular to their direction of separation, said connecting means comprising a web portion of a narrower thickness, when measured in said predetermined direction, than said holding portions, said web portion being integral with said holding portions, said web portion having a generally rectangular shape with a length, as measured in the direction of elongation of said holding portions, which is greater than its thickness and at least as great as the separation between said holding portions, said web portion being made of a resilient material so as to premit said holding portions to move with respect to each other.

2. The chopstick holder of claim 1 wherein one edge of said web portion which extends between said holding portions has a concave shape.

3. The chopstick holder of claim 1, further including at least one elongated spline projecting out from the wall of each of said through holes and tapering longitudinally from a predetermined height up from said wall down to the wall of said through hole, such that when said chopstick of said predetermined transverse dimension is inserted into one of said through holes, said spline will gouge a longitudinal groove into said chopstick, the length of said spline being less than that of said through hole.

4. The chopstick holder of claim 3, further including at least two of said splines projecting out from the wall of each of said through holes.

5. The chopstick holder of claim 3 wherein said spline has a length between 5 and 7 percent of the length of its respective holding portion and is hard enough to gouge a groove in a chopstick made of soft wood.

6. The chopstick holder of claim 3 wherein said spline tapers at an angle between 3 and 5 degrees to the longitudinal axis of its through hole.

7. The chopstick holder of claim 1 wherein said through holes have square cross sections.

8. The chopstick holder of claim 1 wherein said through holes have round cross sections.

9. A chopstick holder, comprising:

a pair of elongated holding portions having a pair of respective through holes of a predetermined dimension for holding a pair of chopsticks of a predetermined transverse dimension in a generally parallel relationship and with the dimensions of said through holes being such that said chopsticks will be held by frictional engagement when they are inserted into said respective through holes, and connecting means for holding said holding portions a fixed distance apart, and in a generally parallel relationship, said fixed distance being at least twice the dimension of each of said through holes, said holding portions having a predetermined thickness, greater than said chopsticks, when measured in a predetermined direction perpendicular to their direction of elongation and perpendicular to their direction of separation, at least one elongated spline projecting out from the wall of each of said through holes and tapering longitudinally from a predetermined height up from said wall down to the wall of said through hole, such that when said chopstick of said predetermined transverse dimension is inserted into one of said through holes, said spline will gouge a longitudinal groove into said chopstick, the length of said spline being less than that of said through hole.

10. The chopstick holder of claim 9 wherein said connecting means comprising a web portion of a narrower thickness, when measured in said predetermined direction, than said holding portions, said web portion being integral with said holding portions, said web portion having a generally rectangular shape with a length, as measured in the direction of elongation of said holding portions, which is greater than its thickness and at least as great great as the separation between said holding portions, said web portion being made of a resilient material so as to premit said holding portions to move with respect to each other.

11. The chopstick holder of claim 10 wherein one edge of said web portion which extends between said holding portions has a concave shape.

12. The chopstick holder of claim 9, further including at least two of said splines projecting out from the wall of each of said through holes.

13. The chopstick holder of claim 9 wherein said spline has a length between 5 and 7 percent of the length of its respective holding portion and is hard enough to gouge a groove in a chopstick made of soft wood.

14. The chopstick holder of claim 13 wherein said spline tapers at an angle between 3 and 5 degrees to the longitudinal axis of its through hole.

15. The chopstick holder of claim 9 wherein said through holes have square cross sections.

16. The chopstick holder of claim 9 wherein said through holes have round cross sections.

* * * * *